US005531833A

United States Patent [19]

Ogasawara et al.

[11] Patent Number: 5,531,833

[45] Date of Patent: Jul. 2, 1996

[54] APPARATUS FOR COATING VEHICLE BODY

[75] Inventors: Toshifumi Ogasawara; Masafumi Shinoda, both of Hiroshima-ken, Japan

[73] Assignee: Mazda Motor Corporation, Hiroshima, Japan

[21] Appl. No.: 366,447

[22] Filed: Dec. 30, 1994

Related U.S. Application Data

[63] Continuation of Ser. No. 15,088, Feb. 9, 1993, abandoned, which is a continuation of Ser. No. 677,693, Mar. 29, 1991, abandoned.

[30] Foreign Application Priority Data

Mar. 30, 1990 [JP] Japan ..... 2-87196
Mar. 28, 1991 [JP] Japan ..... 3-089672

[51] Int. Cl.[6] ..... B05B 12/04

[52] U.S. Cl. ..... 118/698; 118/696; 118/703; 118/314; 118/324

[58] Field of Search ..... 118/314, 324, 118/696, 697, 698, 699, 703, 300, 305; 427/191, 421, 424

[56] References Cited

U.S. PATENT DOCUMENTS

| | | | |
|---|---|---|---|
| 2,754,226 | 7/1956 | Juvinall | 118/314 |
| 3,077,422 | 2/1963 | Slatkin | 118/314 |
| 4,332,012 | 5/1982 | Sekine et al. . | |
| 4,375,498 | 3/1983 | LeMinez et al. | 427/421 |
| 4,590,654 | 5/1986 | Kajiura | 118/697 |
| 4,601,921 | 7/1986 | Lee | 118/300 |
| 4,611,380 | 9/1986 | Abe et al. | 118/697 |
| 4,721,630 | 1/1988 | Takeo et al. | 427/424 |
| 4,770,122 | 9/1988 | Ichihashi et al. | 118/698 |
| 4,905,913 | 3/1990 | Frikker | 427/424 |
| 4,941,182 | 7/1990 | Patel | 901/43 |
| 5,014,644 | 5/1991 | Yamamoto et al. | 118/314 |
| 5,057,342 | 10/1991 | Hoy et al. | 118/300 |
| 5,075,132 | 12/1991 | Ogasawara | 427/421 |
| 5,079,030 | 1/1992 | Tomioka et al. | 118/629 |

FOREIGN PATENT DOCUMENTS 2219226 12/1989 United Kingdom .

*Primary Examiner*—Michael W. Ball
*Assistant Examiner*—Richard Crispino
*Attorney, Agent, or Firm*—Fish & Richardson

[57] ABSTRACT

An overcoat to be formed on an automotive vehicle body is formed by coating an overcoating base paint and, as needed, a solid or clear coating paint. The overcoating is continuously performed in at least three coating stages, wherein a rotary-type atomizing coater is disposed for the first coating stage and an air-nozzle type coater is disposed for each of the second and third coating stages. When a metallic paint having a pale color is coated in all three coating stages, while two coating stages are employed for coating a paint having a relative dark color.

9 Claims, 16 Drawing Sheets

APPARATUS FOR COATING VEHICLE BODY

This application is a continuation of U.S. application Ser. No. 08/015,088, filed Feb. 9, 1993, abandoned upon the filing herewith; which is a continuation of U.S. application Ser. No. 07/677,693, filed Mar. 29, 1991, abandoned.

BACKGROUND OF THE INVENTION

1. Field of the Invention

The present invention relates to a coating line construction and use of same and, more particularly, to a coating line construction so adapted as to coat a coating substrate with a paint in the process of conveying the coating substrate and use thereof.

2. Description of Related Art

Automotive vehicle bodies as a coating substrate are coated with a paint while they are conveyed on a coating line. The automotive vehicle bodies are generally coated sequentially with an undercoating paint, an intercoating paint and an overcoating paint. An overcoat on the automotive vehicle bodies generally comprises a base coat and a clear or solid coat to be formed thereon. The base coat constituting the overcoat serves as a basic portion for determining a final hue of the coat of the automotive vehicle bodies, and paints for the base overcoat are much more abundant in kind than paints for clear or solid coats. Further, oil-base paints have recently started being replaced gradually by water-base paints in order to compete with the environmental problems which are recently gathering increasing attention.

When the coat on the automotive vehicle body is to be mended or corrected, the coat to be mended or corrected is sprayed with a paint manually by an operator. In this case, the paint is sprayed several times in such a limited quantity that the paint is atomized to an extremely fine extent to thereby form a predetermined film thickness on the coat to be mended. Hence, the manual spraying can realize a color of the paint in its original hue, whether the color is pale or dark.

However, when the automotive vehicle bodies are automatically assembled on a large scale, the manual spraying for correcting or mending the coat requires a long period of time so that this is extremely disadvantageous for large-scale production of automotive vehicle bodies.

A coating station of the coating line for coating the automotive vehicle bodies with a base coat generally has two stages disposed in series along the coating line and the two stages for base coating are provided with air-nozzle type coaters. In other words, the conventional base coating station is disposed so as to be capable of coating with two different kinds of paints.

Japanese Patent Laid-open (kokai) Publication No. 289, 265/1987 discloses the technology in which a conveyor is so disposed as to convey automotive vehicle bodies back and forth and one stage is repeatedly employed, thereby allowing the automotive vehicle bodies to be coated with two different types of paints in the one stage.

However, it is to be noted that either of the disposition of the two stages for base coating or the repetitive use of one stage for base coating is to form a predetermined film thickness by coating twice. In this case, as a matter of course, the period of time for coating in each stage is set as short as possible in order to meet with demands for production on a large scale, so that the quantity of the paint to be sprayed from each of the air nozzles in each stage is set larger than required. This means that particles of the paint to be sprayed from the air nozzles become large in size. Hence, in some cases, the extent to which the paint is atomized is not appropriate and the original color of the paint cannot be achieved.

SUMMARY OF THE INVENTION

The object of the present invention is to provide an automatic coating line construction so adapted as to achieve the original color of a paint to such an extent as close to the color thereof produced by manual spraying.

In order to achieve the aforesaid object, the present invention consists of a coating line construction, wherein:

a coating step for coating a substrate with paints having colors similar to each other during conveyance of the substrate comprises at least three coating stages;

each of the coating stages is so disposed sequentially from the upstream side to the downstream side of a coating line as to coat the substrate sequentially with one paint after another without drying the paint previously coated thereon; and each of the coating stages is provided with a coating unit.

The coating line construction according to the present invention enables the paint to be coated several times, so that the film thickness of the coat to be formed by one coating can be made thinner in order to achieve the same film thickness. Therefore, it is possible to coat the paint in a sufficiently finely atomized state and in a limited spraying amount, thereby permitting the automatic coating to be performed in such a manner as close to manual spraying and consequently enabling even a complicated color to be achieved to such an extent as close to its original color. This means that, in conventional cases, when the coat on the automotive vehicle body is found to be poor, incomplete or defective, the automotive vehicle body with such a coat is removed from the coating line for correcting or mending the coat. The coating line construction of the present invention can remarkably reduce a frequency of removal of the automotive vehicle bodies from the coating line for correction.

Even if the coat formed on the substrate is required to be mended or corrected, the correction of the color can readily be made in accordance with the coating line according to the present invention because the resulting coat is close to that formed by manual spraying and there is only a small color difference between the color of the coat to be corrected and the color of the paint to be employed for correction.

It can be noted as a matter of course that not all stages should always be employed although the coating line construction according to the present invention has numerous coating stages. When the original color of the paint can be achieved by coating in only one stage or in two stages, only one stage or two stages is or are enough while the remaining stages are used for an interval zone. In other words, for example, when the two stages located on the downstream end and the two stages located on the upstream end are employed for two-stage coating, the remaining stages interposed between these stages can be employed as an interval zone so that a long interval period of time can be ensured. On the other hand, when two adjacent stages are employed for coating in two stages, the interval period of time can be shortened. This means that the interval period of time can be changed with great ease and freedom by selecting the stages to be employed. As is known, the length of the interval period of time exerts great influence upon the color of the coat. Easy changes of the length of the interval period of time leads to easy adjustment of the appropriate interval period of time so as to comply with the paint to be employed or the color of the coat to be achieved.

Further, as described hereinabove, the coating line construction according to the present invention enables the paint to be coated or sprayed in a finely atomized state. The spraying of the paint in a finely atomized state is effective for preventing the paint from sagging. In other words, when the paint is sprayed or coated in numerous stages, the film thickness of the paint to be sprayed in each stage is made so thin that the paint sprayed can be prevented from sagging. This is particularly true of the spraying of a water-base paint because evaporation of water within the water-base paint is promoted by spraying the paint in a finely atomized state.

Further, the coating line construction according to the present invention preferably coats the automotive vehicle bodies with the paint at least in three stages. It is possible to change paints in the first stage and in the stage that follows. It is preferred to use a cost-oriented paint for the first stage while using a highly quality-oriented paint for the later stage, thereby saving the cost of coating as a whole.

In a preferred aspect of the embodiments according to the present invention, as is known per se, automatic coaters of an air-nozzle type are designed to spray the paint using a high pressure air, so that, for instance, aluminum flakes in a metallic type paint are not caused to stay erect within the coat and they are kept in a flattened state, so that the resulting coat can present the advantages that the best possible color can be produced due to absorption and reflection of light.

It is noted herein, however, that the coaters of an air-nozzle type are less efficient in spraying because they spray the paint with high pressure air. Further, this can be particularly true of corners or curved portions of an outer plate panel for the automotive vehicle body, such as rain rails, etc.

On the other hand, a rotary-type atomizing coater is employed for coating the automotive vehicle bodies. When a metallic type paint is employed, aluminium flakes contained therein may be aggregated due to static electricity or they may be stayed erect due to a low air pressure, thereby producing a less satisfactory color of the metallic type paint. However, the paint can be adsorbed due to adsorbing force originating from the static electricity so that the use of the rotary type atomizing coater presents the advantage that it has a high efficiency of adsorbing the paint.

With the arrangement for the rotary-type atomizing coaters and the air-nozzle type coaters in the manner as in the present invention, the coating line construction according to the present invention can achieve the advantages from both types of the coaters and further perform the coating so as to produce the color as if the paint is sprayed manually.

In other words, by coating the automotive vehicle body with the paint to a film thickness close to a final film thickness by taking advantage of the rotary-type atomizing coaters which are highly efficient, the burdens to be imposed upon the air-nozzle type coaters disposed on the downstream side of the coating line can be reduced.

Hence, the paint can be atomized to a more finely atomized state upon spraying through the nozzle, thereby achieving the coating to such an extent as close to the result of coating obtainable by manual spraying method.

Other objects, features and advantages of the present invention will become apparent in the course of the description of the preferred embodiments, which follows, with reference to the accompanying drawings.

BRIEF DESCRIPTION OF THE DRAWINGS

FIGS. 8 to 10 are graphs showing the relationship of the a value vs. the color difference Δa.

DESCRIPTION OF THE PREFERRED EMBODIMENTS

The present invention will be described more in detail with reference to the accompanying drawing.

Outline of Coating

Generally, automotive vehicle bodies are coated through an undercoating step, an intercoating step and an overcoating step in the coating line.

1. Undercoating Step

The undercoating step is to coat the automotive vehicle bodies with an undercoating paint in conventional manner, for example, by electrodeposition method, in order to impart anti-corrosion properties on the surface of the automotive vehicle body.

2. Intercoating Step

The intercoating step is to coat the undercoated surface of the coat on the automotive vehicle body with an intercoating paint with the purposes to cover pinholes or irregular surfaces with the intercoat and to assist improve a finish (appearance) of an overcoat to be coated on the surface of the intercoat. Further, the intercoat has the functions as protecting the undercoat against an external impact, protecting water penetrated through the overcoat from reaching the undercoat, and improving adhesion of the overcoat. The intercoating step is generally carried out by air spraying or electrostatic coating method.

3. Overcoating Step

Figure 1:
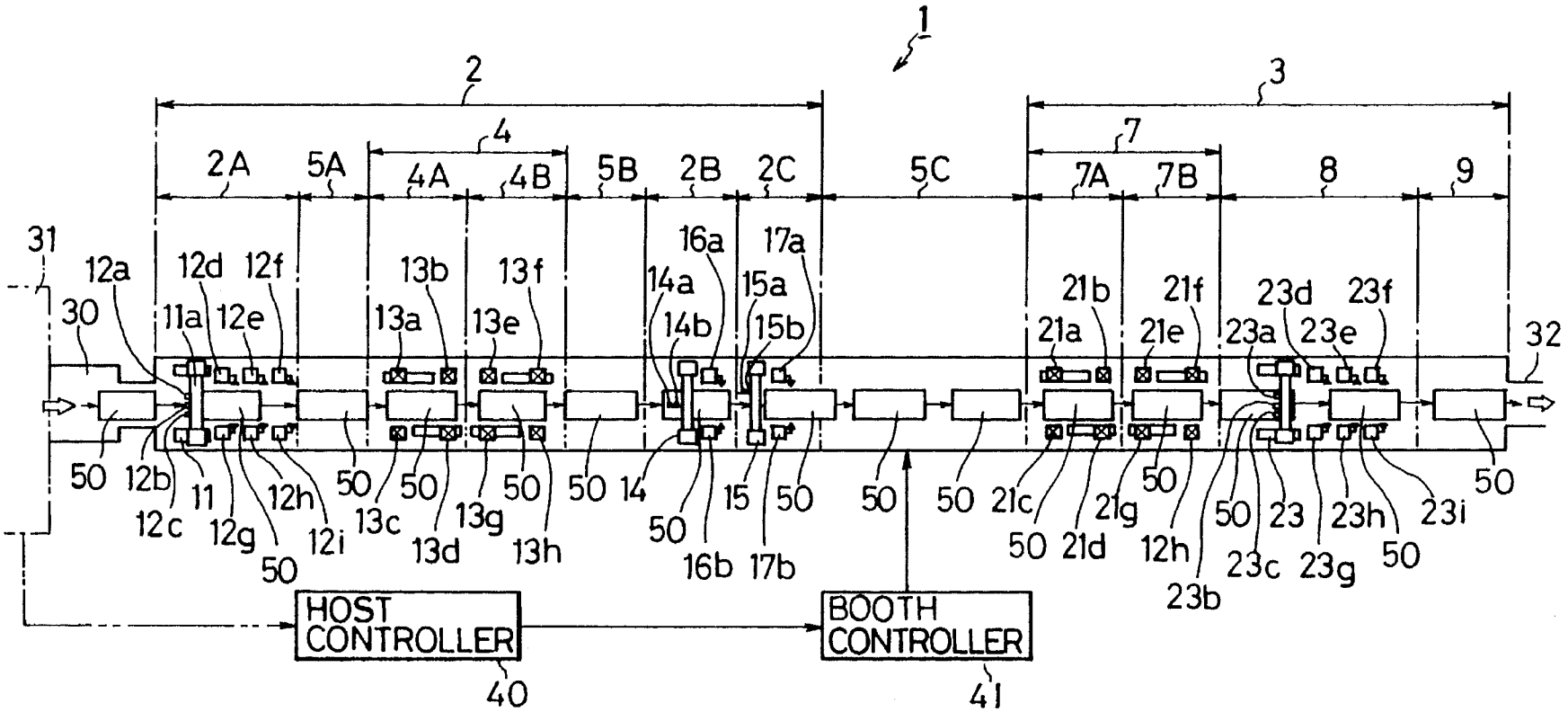
FIG. 1 is a diagrammatic representation showing an overall outline of the coating line according to an embodiment of the present invention.

As shown in FIG. 1, reference numeral 1 denotes a coating booth for the overcoating step.

The coating booth 1 is for coating an oil-base paint and it may roughly be broken down into two stations 2 and 8, i.e. a base-coating station 2 disposed on the upstream side is for coating a base coat and a solid-clear coating station 3 disposed on the downstream side is for coating a solid or clear coat.

As shown in FIG. 1, reference numeral 30 denotes an inlet section for conveying the automotive vehicle bodies into the coating booth 1 and the inlet section 30 is located immediately rearward of a color selecting station 31 and on the upstream side of the base-coating station 2.

a. Base Coating Station 2

The base coating station 2 comprises at least five coating stages which include three stages 2A, 2B and 2C for coating outer plates of an automotive vehicle body 50 and two stages 4A and 4B for coating inner plates thereof. The first outer plate coating stage 2A is disposed on the upstream side, the second outer plate coating stage 2B is disposed on the intermediate side, and the third outer plate coating stage 2C is disposed on the downstream side. On the other hand, the first inner-plate coating stage 4A is disposed on the upstream side and the second inner-plate coating stage 4B is disposed on the downstream side, while the first outer-plate coating stage 4A and the second outer-plate coating stage 4B are interposed between the first outer-plate coating stage 2A and the second outer-plate coating stage 2B.

Between the first outer-plate coating stage 2A and the first inner-plate coating stage 4A is interposed a first idling zone 5A as an interval zone, while a second idling zone 5B as an interval zone is disposed between the second outer-plate coating stage 2B and the second inner-plate coating stage 4B.

a-1. First Outer Plate Coating Stage 2A

The first outer-plate coating stage 2A may be provided with a first group of a pair of three electrostatically, rotary-type atomizing coaters 12*a*, 12*b* and 12*c* so supported on the beam portion 11*a* of a gate-shaped support body 11 as to be displaceable in the transverse direction, i.e. in the widthwise direction of the automotive vehicle body 50, and in the vertical direction thereof, and with a second group of six electrostatically, rotary-type atomizing coaters 12*d*, 12*e*, 12*f*, 12*g*, 12*h* and 12*i* disposed sequentially spaced apart in a predetermined distance from each other behind the first group of the electrostatically rotary-type atomizing coaters on the both sides. More specifically, the coaters 12*d* to 12*f* are disposed sequentially from the upstream side to the downstream side on one side of and alone the coating line, while the coaters 12*g* to 12*i* are disposed sequentially on the opposite side thereof from the upstream side to the downstream side.

In other words, the first outer-plate coating stage 2A is arranged to form a base overcoat by the electrostatically, rotary-type atomizing coaters.

a-2. First & Second Inner Plate Coating Stages 4A & 4B

As shown in FIG. 1, in the first inner-plate coating stage 4A, two of coating robots 13*a* and 13*b* are disposed sequentially on one side of the coating line from the upstream side to the downstream side thereof, while two of coating robots 13*c* and 13*d* are disposed sequentially on the opposite side of the coating line from the upstream side to the downstream side thereof, respectively. Likewise, in the second inner-plate coating stage 4B, two of coating robots 13*e* and 13*f* are disposed sequentially on one side of the coating line, adjacent the coating robots 13*b*, from the upstream side to the downstream side thereof, while another two of coating robots 13*g* and 13*h* are disposed on the opposite side thereof from the upstream side to the downstream side thereof, respectively.

The coating robots 13*a* to 13*h* are so arranged as to form a base coat on the inner plate panel of the automotive vehicle body 50.

a-3. Second & Third Outer Plate Coating Stages 2B & 2C

The second outer-plate coating stage 2B is provided with a first group of air-nozzle type coaters 14*a* and 14*b* so supported on a gate-shaped support body 14 as to be displaceable in both of the vertical and tilted direction with respect to the coating line. Also the third outer-plate coating stage 2C is provided with a second group of air-nozzle type coaters 15*a* and 15*b* so supported on a gate-shaped support body 15 as to be displaceable in both of the vertical direction and the tilted direction with respect thereto. Further, a third group of air-nozzle type soarers 16*a* and 16*b* are disposed on the both sides of the coating line in the second outer-plate coating stage 2B so as to interpose the automotive vehicle body 50 conveyed through the coating line, while a fourth group of air-nozzle type coaters 17*a* and 16 are likewise disposed on the both sides of the coating line in the third outer-plate coating stage 2C.

In other words, the second and third outer-plate coating stages 2B and 2C are constructed to coat the automotive vehicle body 50 with a base overcoat by the air-nozzle type coaters.

b. Solid-Clear Coating Station 3482

The third outer-plate coating stale 2C on the most downstream side of the base coating station 2 is followed by a third idle zone 5C. To this third idle zone 5C is connected a solid-clear coating station 3 for forming a solid or clear coat on the vehicle bodies being conveyed on the coating line, i.e. the solid-clear coating station 3 being disposed on the upstream side of the third idle zone 5C.

The solid-clear coating station 3 comprises a first inner-plate coating stage 7A and a second inner-plate coating stage 7B, each for coating a solid or clear coat on the inner plates of the automotive vehicle bodies, an outer-plate coating stage 8 for coating a solid or clear coat on the outer plates thereof, and a buffer zone 9. In FIG. 1, reference numeral 32 denotes a downstream outlet for discharging the automotive vehicle bodies from the coating station for checking the quality of the coat formed on the automotive vehicle bodies.

The first outer-plate coating stage 7A has coating robots 21*a* and 21*b* disposed on one side from the upstream side to the downstream side of the coating line, while it has coating robots 21*c* and 21*d* disposed on the opposite side from the upstream side to the downstream side thereof in the same manner as on the other side, thereby allowing the coating robots to form a solid or clear overcoat the automotive vehicle body being conveyed through the coating line.

The second outer-plate coating stage 7B has coating robots 21*e* and 21*f* disposed on one side from the upstream side to the downstream side of the coating line, while it has coating robots 21*g* and 21*h* disposed on the opposite side from the upstream side to the downstream side thereof in the same manner as on the other side, thereby allowing the coating robots to coat the automotive vehicle body from their left-hand and right-hand sides while being conveyed through the coating line.

In the outer-plate coating station 8, a gate-shaped support body 23 is disposed bridging the coating line through which the automotive vehicle bodies are conveyed. On the gate-shaped support body 23 are so mounted first, second and third electrostatically, rotary-type atomizing coaters 23*a* to 23*c* as to be displaceable in the vertical and transverse directions with respect to the coating line. Further, fourth, fifth and sixth electrostatically, rotary-type atomizing coaters 23*d*, 23*e* and 23*f* are sequentially disposed in a predetermined spaced relationship on and along one side of the coating line, while seventh, eighth and ninth electrostatically, rotary-type atomizing coaters 23*g*, 28*h* and 23*i* are likewise disposed in a predetermined spaced relationship sequentially on and along the opposite side thereof.

In FIG. 1, reference numeral 40 denotes a host controller for controlling the coating line for the automotive vehicle bodies as a whole and data on the automotive vehicle bodies conveying into the coating booth 1, such as models, colors, coating purposes, etc., is inputted from the color selecting station 31 into the host controller 40. The data is then transmitted to a booth controller 41 which in turn is so arranged as to control coating conditions, such as selection of either of stages in the base-coating station 2 and the solid-clear coating station 3, operating state, idling time (interval time) for idle zones, etc., in accordance with operation modes as shown in Table 1, on the basis of the data supplied from the host controller 40.

Description will now be made of the method for coating automotive vehicle bodies 50 with reference to Operation tables as shown in Table 1.

flakes to aggregate due to static electricity or to stay erect due to low air pressures, whereby favorable color is not necessarily given.

In order to solve those problems, the coating is performed by the air-nozzle type coaters 14*a*–14*b* and 16*a*–16*b* in the second outer-plate coating stage 2B and by the air-nozzle type coaters 15*a*–15*b* and 17*a*–17*b* in the third outer-plate coating stage 2C, thereby allowing an aggregated state of the aluminum particles at a surface area to be agitated or laying the aluminum flakes down due to high air pressures. This arrangement for the second and third outer-plate coating stages 2B and 2C can provide a favorable coat surface in which the metallic particles are finely divided.

TABLE 1

| Data On Vehicle Body | Vehicle Model (Grade) High | Medium | Regular | Coat Color Dark | Pale | Purpose Special Color | Ordinary |
|---|---|---|---|---|---|---|---|
| Oil-Base Paint | Rotary Atomizer 2A ↓ Air-Nozzle 2B ↓ Air-Nozzle 2C | Rotary Atomizer 2A ↓ Air-Nozzle 2B | Air-Nozzle 2B ↓ Air-Nozzle 2C | Rotary Atomizer 2A ↓ Air-Nozzle 2B | Rotary Atomizer 2A ↓ Air-Nozzle 2B ↓ Air-Nozzle 2C | Rotary Atomizer 2A ↓ Air-Nozzle 2B ↓ Air-Nozzle 2C | Air-Nozzle 2A ↓ Air-Nozzle 2B |
| Water-Base Paint | Rotary Atomizer 2A ↓ Air-Nozzle 2B ↓ Air-Nozzle 2C | Rotary Atomizer 2A ↓ Air-Nozzle 2B | Rotary Atomizer 2A ↓ Air-Nozzle 2B | Rotary Atomizer 2A ↓ Air-Nozzle 2B | Rotary Atomizer 2A ↓ Air-Nozzle 2B ↓ Air-Nozzle 2C | Rotary Atomizer 2A ↓ Air-Nozzle 2B ↓ Air-Nozzle 2C | Rotary Atomizer 2A ↓ Air-Nozzle 2B |

Table 1 contains a total of fourteen coating processes which are comprised of a combination among first, second and third outer-plate coating stages 2A, 2B and 2C in the base-overcoating station 2.

For instance when an oil-base paint is selected in accordance with the grade of the automotive vehicle body ("REGULAR" under column in Table 1) and when an oil-base paint is selected in accordance with the purpose of coating ("GENERAL" under column in Table 1), the second and third outer-plate coating stages 2B and 2C are employed for coating the automotive vehicle body two times with base coating paints through air-nozzle type coaters, without employment of the first outer-plate coating stage 2A. These cases correspond to conventional two-stage coating processes in which the air-nozzle type coaters are employed twice.

In any other case, even a corner portion or a rough surface of the automotive vehicle body can be sprayed with a paint with high efficiency and efficacy by using the electrostatically, rotary-type atomizing coaters 12*a* to 12*i* in the first outer-plate coating stage 2A.

On the other hand, it is to be noted that, for instance, when there is employed a metallic type paint including such silver metallic paint or beige metallic paint as containing aluminium particles, only the coating in the first outer-plate coating stage 2A using the electrostatically, rotary-type atomizing coaters 12*a* to 12*i*, inclusive, may cause the aluminium particles within the metallic paint as aluminium In other words, the coating line is so arranged as to allow selection of the two-stage coating (using the first outer-plate coating stage 2A and the second outer-plate coating stage 2B or the third outer-plate coating stage 2C) or the three-stage coating (using the first, second and third outer-plate coating stages 2A, 2B and 2C), on the basis of a combination of the rank or grade of the models of automotive vehicle bodies, grades of color or color quality, purposes of coating, kinds of paints, etc., with optimum realization or production and compensation or correction of desired color and coating efficiency.

More specifically, when the two-stage coating process is applied in the event that the grade of the model is so high that the coating of high quality is required or in the event that a color of coat is so pale that the coating is extremely delicate or in the event that a special color newly developed is to be applied, compensation or correction is required to be performed in an extremely strict way in order to correct the color of the coat, for example, with the difference of lightness, the difference of chroma, etc. on the coat itself taken into consideration.

Hence, when such a highly qualified coat is required, the three-stage coating using the first, second and third outer-plate coating stages 2A, 2B and 2C are employed in order to realize or create the desired color with desired quality rather than to place priority upon coating efficiency.

On the other hand, however, when no such a high quality of coat is required, the two-stage coating using the first outer-plate coating stage 2A and the second outer-plate coating stage 2B or the third outer-plate coating stage 2C is performed with priority placed over the efficiency of coating work rather over the realization or production of highly qualified color, as long as the two-stage coating can provide the coat with satisfiable color and other qualities.

As paints to be used for the two-stage coating or for the three-stage coating, there may be employed oil-base paints and water-base paints. It is to be noted herein that, as the water-base paints are electrically conductive in themselves, the air nozzle may be electrically grounded when electric charge is directly applied to the air nozzle. In order to avoid such a problem, it is desired to use the air nozzles of an external electrode type when the water-base paints are employed.

Figure 5:
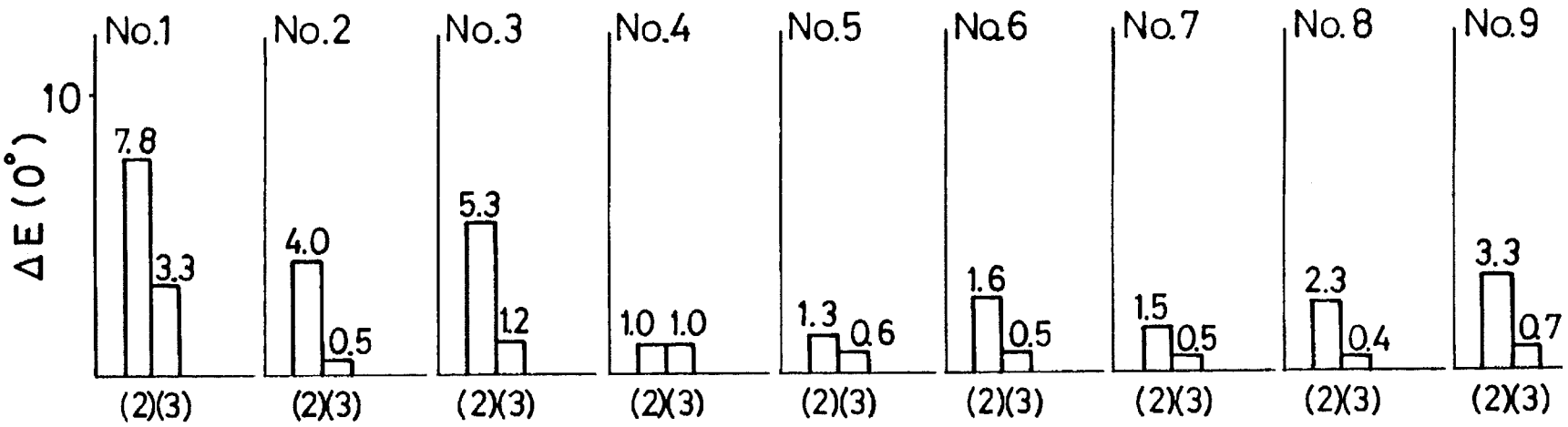
FIGS. 5 to 7 are each a graph showing the color difference ΔE between the two-stage coating and the three-stage coating.

Further, in order to use the coating booth 1 for both of the water-base paints and the oil-base paints, it is preferred to interpose a preheating station 60 between the base-coating station 2 and the solid-clear coating station 3, as shown in FIG. 5. Likewise, it is desired to interpose a preheating station 62 between the solid-clear coating station 3 and a baking station 61.

The preheating stations 60 and 62 are disposed to remove water or moisture contained in the coat formed by the water-base paints. It should be noted herein that, when the oil-base paints are employed, the disposition of the preheating stations 60 and 62 are not desired because the coat formed by the oil-base paint may cause pinholes or the like during preheating. In order to avoid such problems, the heating in the preheating stations 60 and 62 can be suspended or a bypass may be provided so as to allow the automotive vehicle bodies 50 coated with the oil-base paint to bypass the preheating stations 60 and 62. It is further noted that the water-base paints may be employed in the base-coating station 2 while the oil-base paints may be employed in the solid-clear coating station 3 or, conversely, the oil-base paints may be employed in the base-coating station 2 and the water-base paints may be employed in the solid-clear coating station 3.

In this embodiment, as shown in FIG. 1, the first and second inner-plate coating stages 4A and 4B are interposed between the first and second outer-plate coating stages 2A and 2B. Hence, it is possible to employ the inner-plate coating stages 4A and 4B as an interval zone between the first outer-plate coating stage 2A and the second outer-plate coating stage 2B, when it is not required to use the inner-plate coating stages 4A and 4B for coating. When the interval time between the first outer-plate coating stage 2A and the second outer-plate coating stage 2B is represented by t1 and the interval time between the second outer-plate coating stage 2B and the third outer-plate coating stage 2C is represented by t2, the time required by the three-stage coating and the two-stage coating can be represented as follows:

(1) Three-stage coating using the first, second and third outer-plate coating stages 2A, 2B and 2C:

The total period of time required for the three-stage coating is the sum of t1 and t2 because the period of time required for the first and second outer-plate coating stages 2A and 2B is represented by t1 as well as the period of time required for the second and third outer-plate coating stages 2B and 2C is represented by t2.

(2) Two-stage coating using the first and second outer-plate coating stages 2A and 2B:

The period of time for the aforesaid two-stage coating is t1.

(3) Two-stage coating using the first and third outer-plate coating stages 2A and 2C:

The period of time for the aforesaid two-stage coating is t1+t2.

(4) Two-stage coating using the second and third outer-plate coating stages 2B and 2C:

The period of time for the aforesaid two-stage coating is t2.

From the foregoing, it is possible to adjust the interval period of time by selecting either one of items (2) to (4) above particularly in the two-stage coating.

Figure 2:
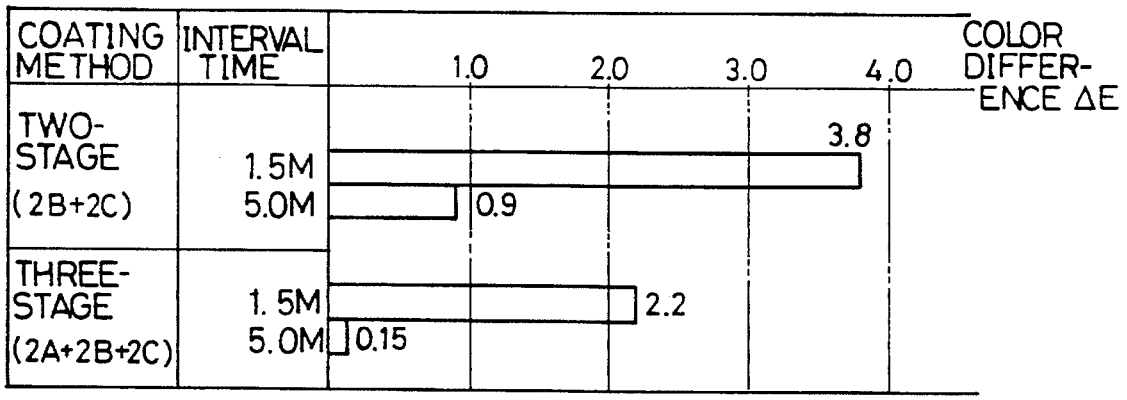
FIG. 2 is a graph showing the color difference ΔE between two-stage coating and three-stage coating.
Figure 3:
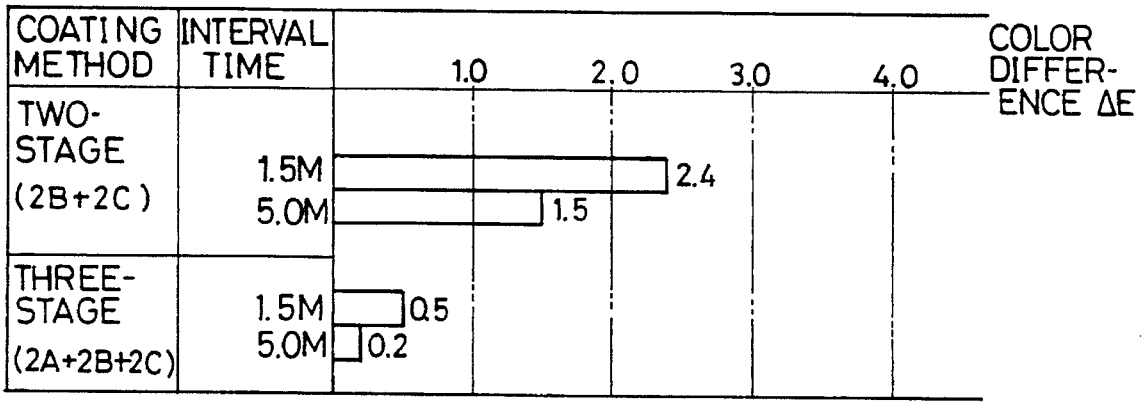
FIG. 3 is a graph showing the color difference ΔE between two-stage coating and three-stage coating.
Figure 4:
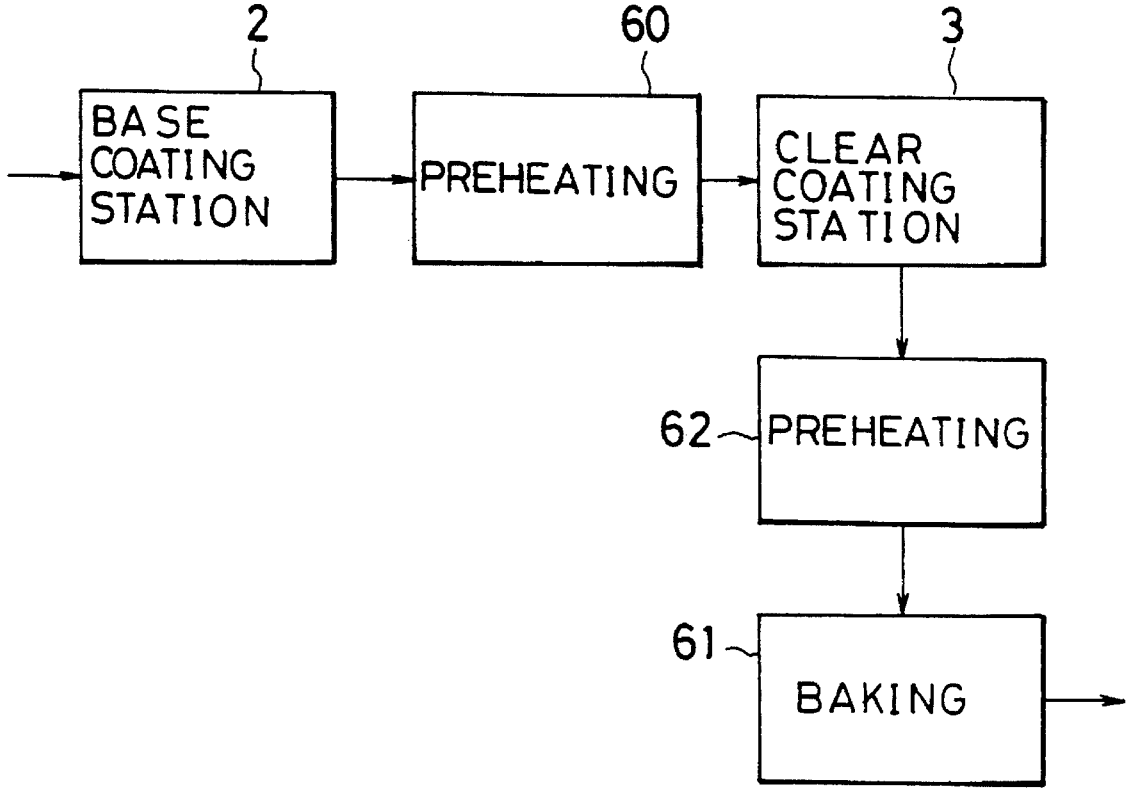
FIG. 4 is a block diagram showing the steps and processes of the coating line construction according to the present invention.

FIGS. 2 and 3 show the relationship of the interval period of time versus color difference ΔE. The color difference ΔE referred to herein is based on comparison with the color of coat when formed manually. FIG. 2 relates to a silver metallic coat, while FIG. 3 relates to a beige metallic coat. In these experiments, the first and third outer-plate coating stage 2A and 2C are employed for the two-stage coating, although the three-stage coating is performed using the first, two and three outer-plate coating stages 2A, 2B and 2C. Further, the interval period of time of 1.5 minutes means that each of the period of time t1 required between the first and second outer-plate coating stages 2A and 2B and the period of time t2 required between the second and third outer-plate coating stages 2B and 2C is 1.5 minutes, Likewise, the interval period of time of 5 minutes means that each of the period of time t1 and the period of time t2 is 5 minutes. Hence, this two-stage coating has the interval time as long as 1.5 minutes or 5 minutes between the second and third outer-plate coating stages 2B and 2C. And this three-stage coating has the interval time as long as 1.5 minutes or 5 minutes between the first and second outer-plate coating stages 2A and 2B as well as between the second and third outer-plate coating stages 2B and 2C.

As is apparent from FIGS. 2 and 3, it is to be understood in either case that the interval time exerts an influence upon the color difference ΔE. It is noted herein that a smaller color difference ΔE means that the color is closer to the desired color and that accuracy in realization or production of the objective color gets higher as the color difference ΔE gets smaller.

In other words, the favorable and desired color can be realized by changing the interval time t1 and/or t2 in accordance with the model of automotive vehicle bodies, coat color, coating paint to be employed, etc. Further, it is possible to virtually alter the interval time by changing the coating stage for the two-stage coating to be applied although the interval times t1 and t2 are set to a predetermined period of time.

Table 2 below shows experiment conditions for the two-stage coating and the three-stage coating.

TABLE 2

| Sample Nos. | No. 1 | No. 2 | No. 3 | No. 4 | No. 5 | No. 6 | No. 7 | No. 8 | No. 9 |
|---|---|---|---|---|---|---|---|---|---|
| Color | Five | Three | Two | Nine | One | Eight | Six | Seven | Four |

TABLE 2-continued

| Sample Nos. | No. 1 | No. 2 | No. 3 | No. 4 | No. 5 | No. 6 | No. 7 | No. 8 | No. 9 |
|---|---|---|---|---|---|---|---|---|---|
| Formulation Type of Paint | Colors Acryl-Melamine Type Base-Coating Paint | Colors Same | Colors Same | Colors Same | Colors Same | Colors Same | Colors Same | Colors Same | Colors Same |
| Unvolatile Ingredient | 22–23 wt % | Same | Same | Same | Same | Same | Same | Same | Same |
| Coating Viscosity (#4 FC/20° C.) | 13–13.5 seconds | Same | Same | Same | Same | Same | Same | Same | Same |
| Color Classification | beige metallic | beige metallic | silver metallic | gray metallic | gray metallic | blue metallic | red metallic | dark gray metallic | green metallic |
| Type and Amount of Additives | Standard aluminum flakes 20–25 μ 2.5 wt % | Highly luminant aluminum flakes 20–25 μ 2.0 wt % Mica flakes 25 μ 1.0 wt % | Highly luminant aluminum flakes 20–25 μ 2.0 wt % Mica flakes 25 μ 1.0 wt % | Fine Aluminum flakes 10–15 μ 4.5 wt % | Standard aluminum flakes 20–25 μ 1.0 wt % | Super-fine Aluminum flakes −10 μ 1.5 wt % | Colored mica 1.0 wt % | White mica, 0.2 wt % Colored mica, 0.2 wt % Graphite 9 wt % (Comb'd color) | Micro-titanium Fine aluminum (Comb'd color) |

Specifically, the coating conditions for the two-stage coating and the three-stage coating are as follows:

Two-stage Coating:

| | Ist Stage | 2nd Stage |
|---|---|---|
| Coater | air-nozzle | air-nozzle |
| Nozzle model | #11/#24 | #11/#24 |
| Voltage | −90 KV | −90 KV |
| Coating type | recipro-cating | recipro-cating |
| Discharging amount/minute | 350 cc | 280 cc |
| Air pressure | 3.0 kg/cm$^2$ | 3.0 kg/cm$^2$ |
| Film thickness | 10 microns | 8 microns |
| Conveying speed | 4 m/min | 4 m/min |
| Spraying interval | | |
| 1st–2nd stages | | 2 minutes |
| 2nd–clear | | 5 minutes |
| Booth temperature | | 20° C. |
| Coating distance | | 300 m/m |

Three-stage Coating:

| | Ist Stage | 2nd Stage | 3rd Stage |
|---|---|---|---|
| Coater | rotary atomizer | air-nozzle | air-nozzle |
| Nozzle model | 50 ϕ | #11/#24 | #11/#24 |
| Voltage | −90 KV | −90 KV | −90 KV |
| Coating type | recipro-cating | recipro-cating | recipro-cating |
| Discharging amount/minute | 190 cc | 120 cc | 120 cc |
| Air pressure | (S/A 2.0 kg/cm$^2$) | 2.5 kg/cm$^2$ | 2.5 kg/cm$^2$ |
| No. of revolution | 30,000 rpm | — | — |
| Film thickness | 10 microns | 4 microns | 4 microns |
| Conveying speed | 4 m/min | 4 m/min | 4 m/min |
| Spraying interval | | | |
| 1st–2nd stages | | 10 minutes | |
| 2nd–3rd stages | | 2 minutes | |

-continued

| | |
|---|---|
| (3rd–clear) | 5 minutes |
| Booth temperature | 20° C. |
| Coating distance | 300 m/m |

As described hereinabove, it is to be noted that the amount of discharge of the paint from the nozzle in each of the second and third coating stages for the three-stage coating is 120 cc per minute, while the amounts of discharge of the paint from the nozzle for the two-stage coating are 350 cc per minute in the first coating stage 2A and 280 cc per minute in the second coating stage 2B. Therefore, the amount of discharge of the paint in each of the second and third coating stages for the three-stage coating is restricted more than that in the corresponding stages for the two-stage coating. This means that the paint is more finely atomized in the three-stage coating than in the two-stage coating.

Manually Spraying for Comparison:

| | |
|---|---|
| Coater | IWATA W-71 |
| Discharging amount/minute | 150 cc |
| Air pressure | 2.0 kg/cm$^2$ |
| Film thickness | 15–20 microns |
| Double-coating | Equally sprayed twice at an interval of 5 minutes |

Table 3 below shows results of evaluation for color matching.

TABLE 3

| Sample Nos. | | No. 1 | No. 2 | No. 3 | No. 4 | No. 5 | No. 6 | No. 7 | No. 8 | No. 9 |
|---|---|---|---|---|---|---|---|---|---|---|
| Block Coating | Two-stage coating | 3 | 2 | 2 | 3 | 5 | 1 | 5 | 1 | 1 |
| | Three-stage coating | 5 | 5 | 5 | 5 | 5 | 5 | 5 | 4 | 5 |
| Spot Coating | Two-stage coating | 3 | 1 | 1 | 2 | 5 | 1 | 5 | 1 | 2 |
| | Three-stage coating | 5 | 5 | 5 | 5 | 5 | 5 | 5 | 5 | 5 |

The color matching was evaluated visually by five ratings in which rating "5" means best and rating "1" means poor. It is to be noted herein that rating "3" or higher is required in order to make the color practically applicable.

In Table 3, the term "block coating" means the coating of an element of the automotive vehicle body 50, such as a front fender, as a whole, while the term "spot coating" means the coating of a portion of an element thereof. In the block coating, on the one hand, the evaluation of color matching is made by comparing the color of the coat on the element coated by the block coating with the other element manually sprayed. In the spot coating, on the other hand, the evaluation of color matching is made by comparing the spot coated by the spot coating with the surrounding portion manually sprayed.

As is apparent from Table 3, all samples experimented, but samples No. 5 and No. 7, have better results achieved by the three-stage coating than by the two-stage coating.

The samples as indicated in Table 3 were measured for their color differences ΔE with those sprayed manually. It is to be noted that the color difference ΔE is a measure for making overall evaluation of the color of the coat and it is represented by the following relationship:

$$E=\sqrt{a^2 - \overline{b^2} - \overline{L^2}}$$

(wherein a, b and L are those as will be described hereinafter).

Figure 6:
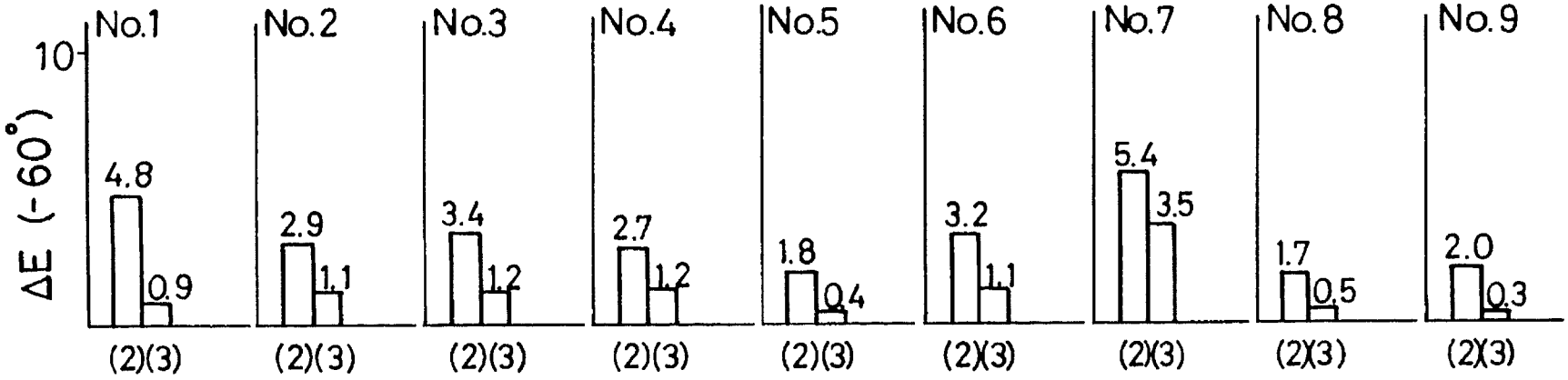
Figure 7:
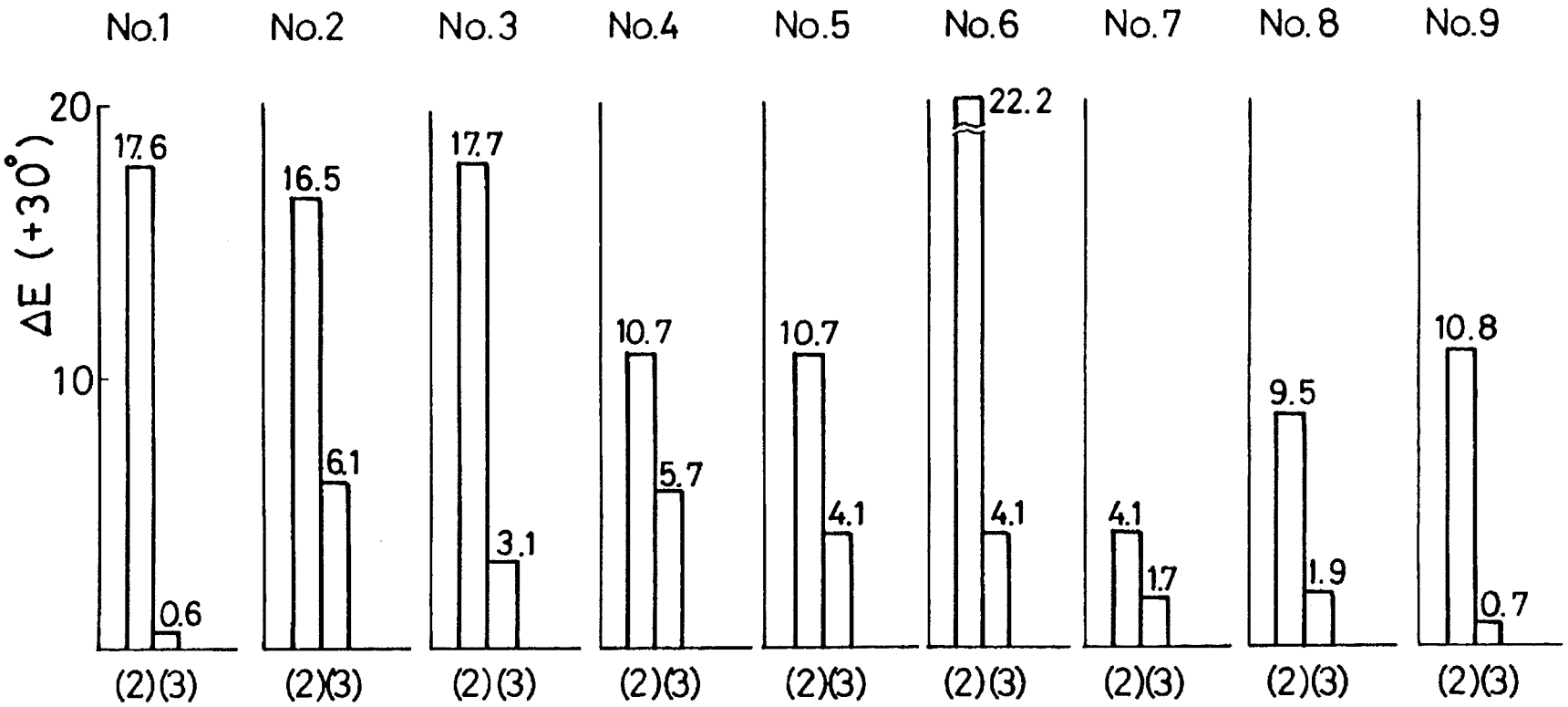

The results are shown in FIGS. 5 to 7. In FIGS. 5 to 7, No. 1. No. 9, inclusive, mean sample Nos. referred to in Tables 2 and 3 and numerals "2" and "8" sandwiched by the round brackets () under the x-axis denote the two-stage coating and the three-stage coating, respectively. Further, FIG. 5 shows the results when measured at the angle of incidence of −45° and the angle of sight of 0°, FIG. 6 shows the results when measured at the angle of incidence of −45° and the angle of sight of −60°, and FIG. 7 shows the results when measured at the angle of incidence of −45° and the angle of sight of −30°. It is noted herein that the angle of incidence referred to therein is the angle at which light is applied to the coat of the sample with respect to the axis perpendicular or vertical to the coat surface thereof, i.e. the vertical axis at the angle of 0°. Likewise the angle of sight referred to therein is the angle at which the light reflected from the coat surface is viewed with respect to the axis perpendicular or vertical to the coat surface. Specifically, the incident angle of −45° means that the light is applied at the angle of 45° from one side with respect to the axis perpendicular or vertical to the coat surface and the angle of sight of +30° means that the degree of reflection is viewed at the angle of 30° with respect to the vertical axis from the opposite side. This is applicable to the later description.

As apparent from the results of the color differences ΔE as indicated in FIGS. 5 to 7, the three-stage coating has provided better evaluation results for all the samples tested than the two-stage coating, because the three-stage coating has demonstrated lower color difference ΔE, except sample No. 4, when the light was applied at the incident angle of 45°.

Figure 8:
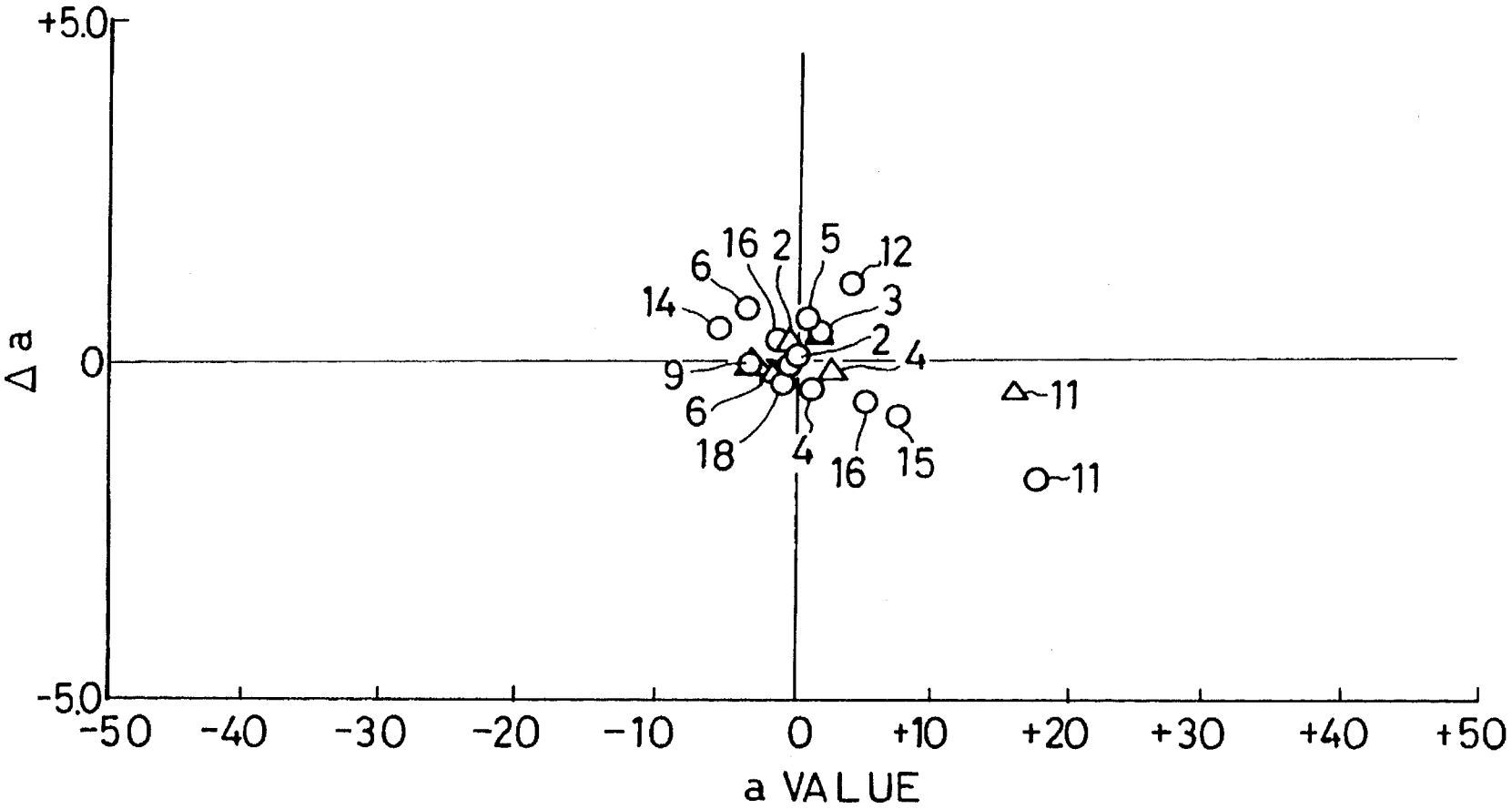
Figure 9:
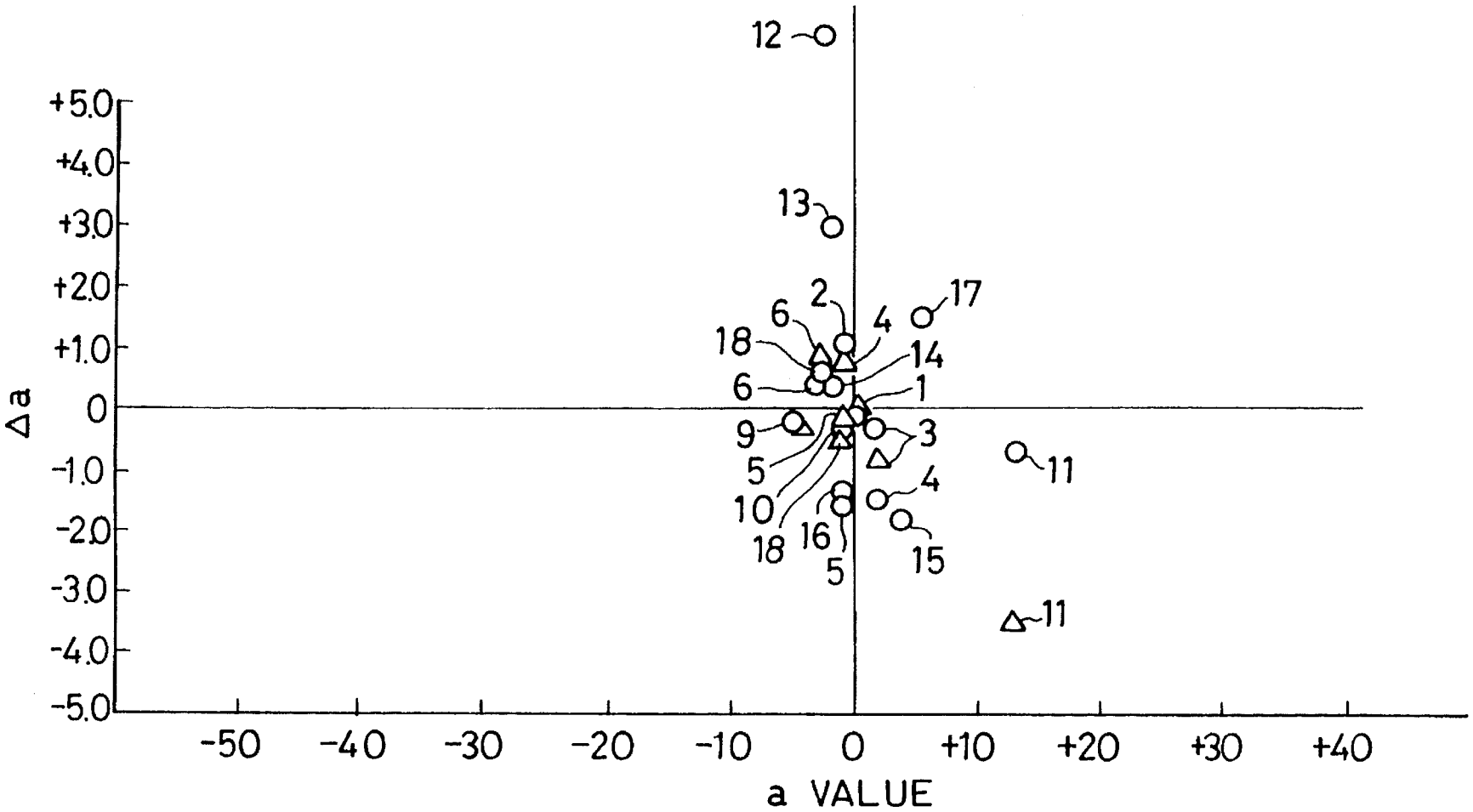
Figure 10:
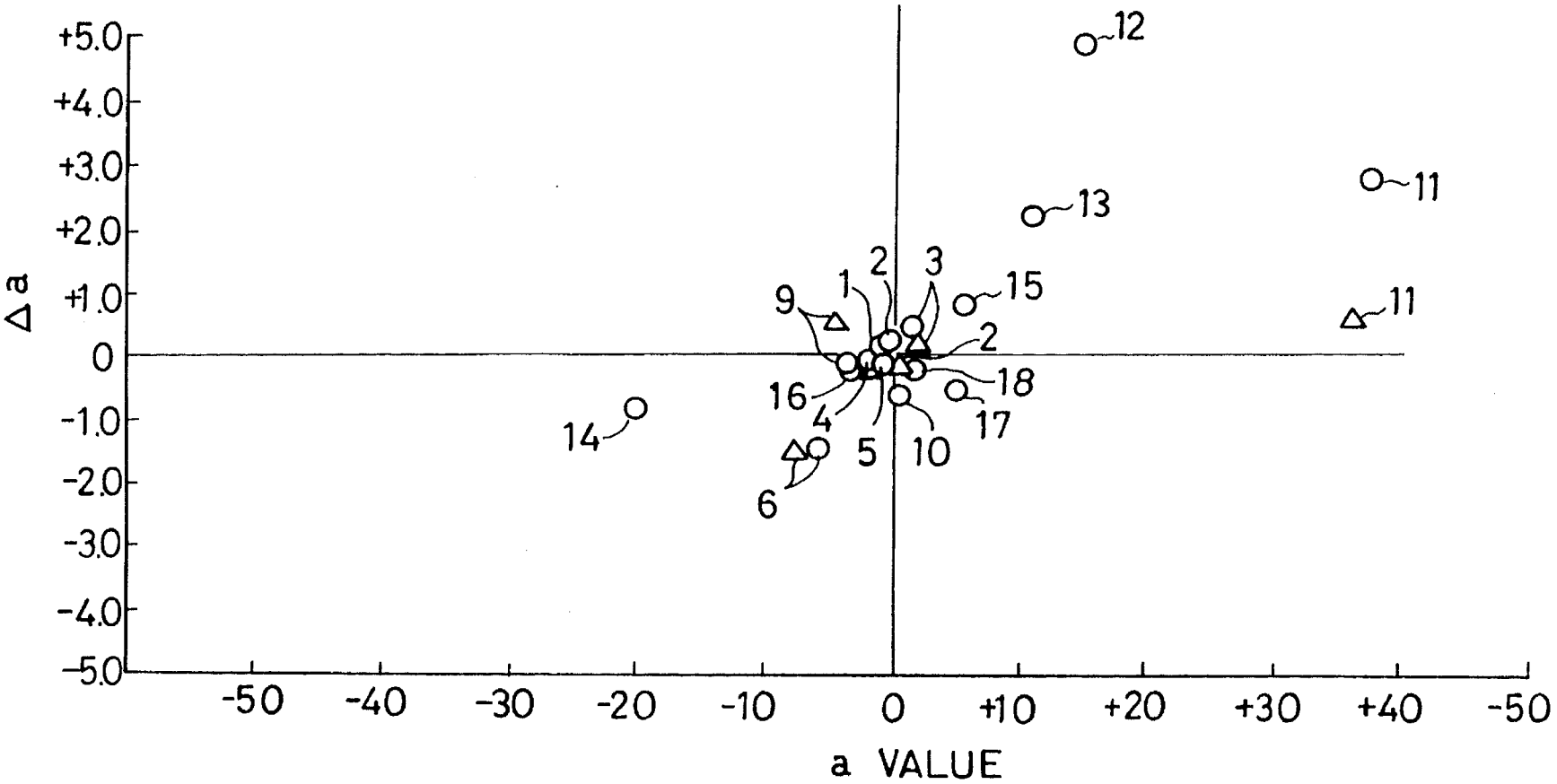
Figure 11:
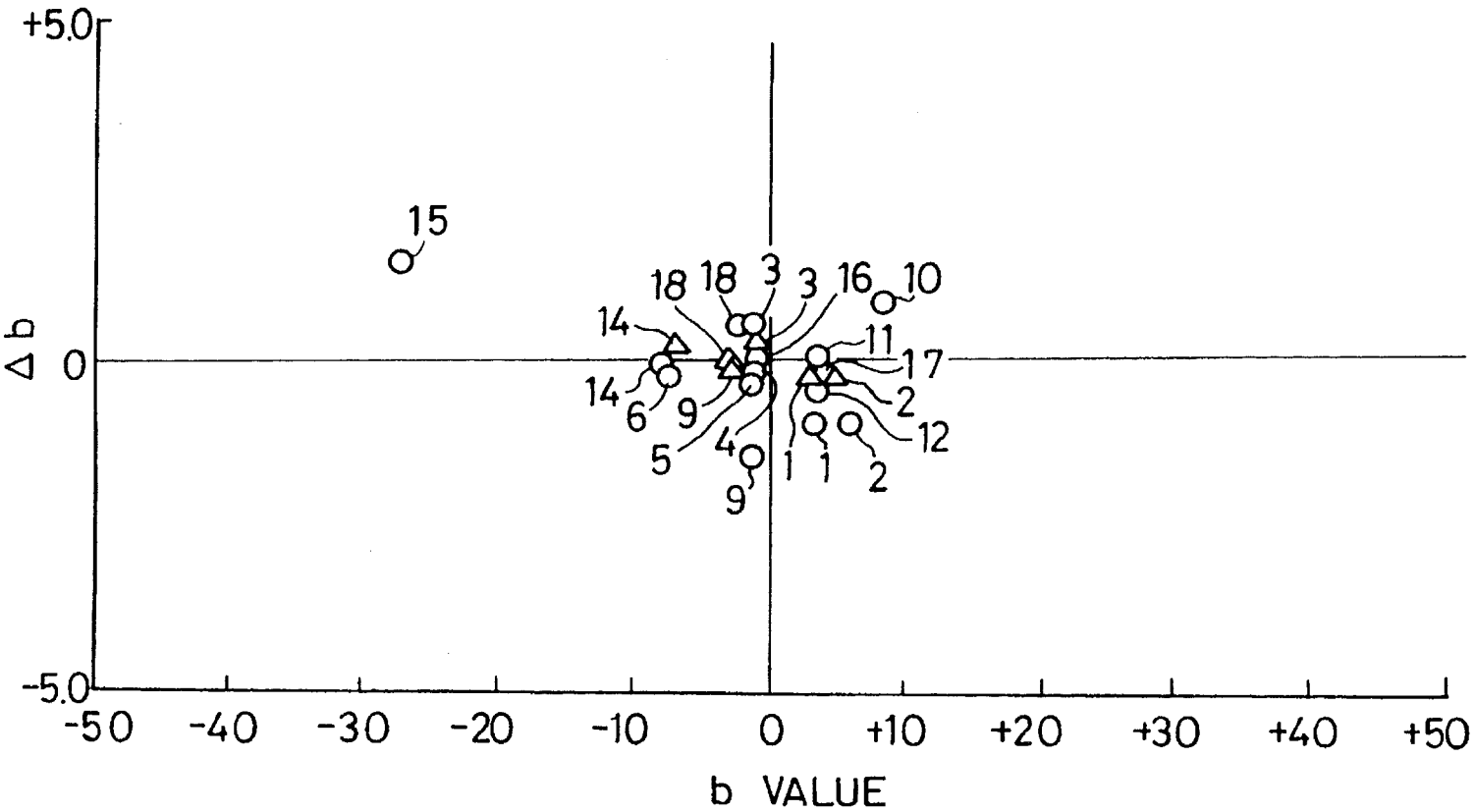
FIGS. 11 to 13 are graphs showing the relationship of the b value vs. the color difference Δb.
Figure 12:
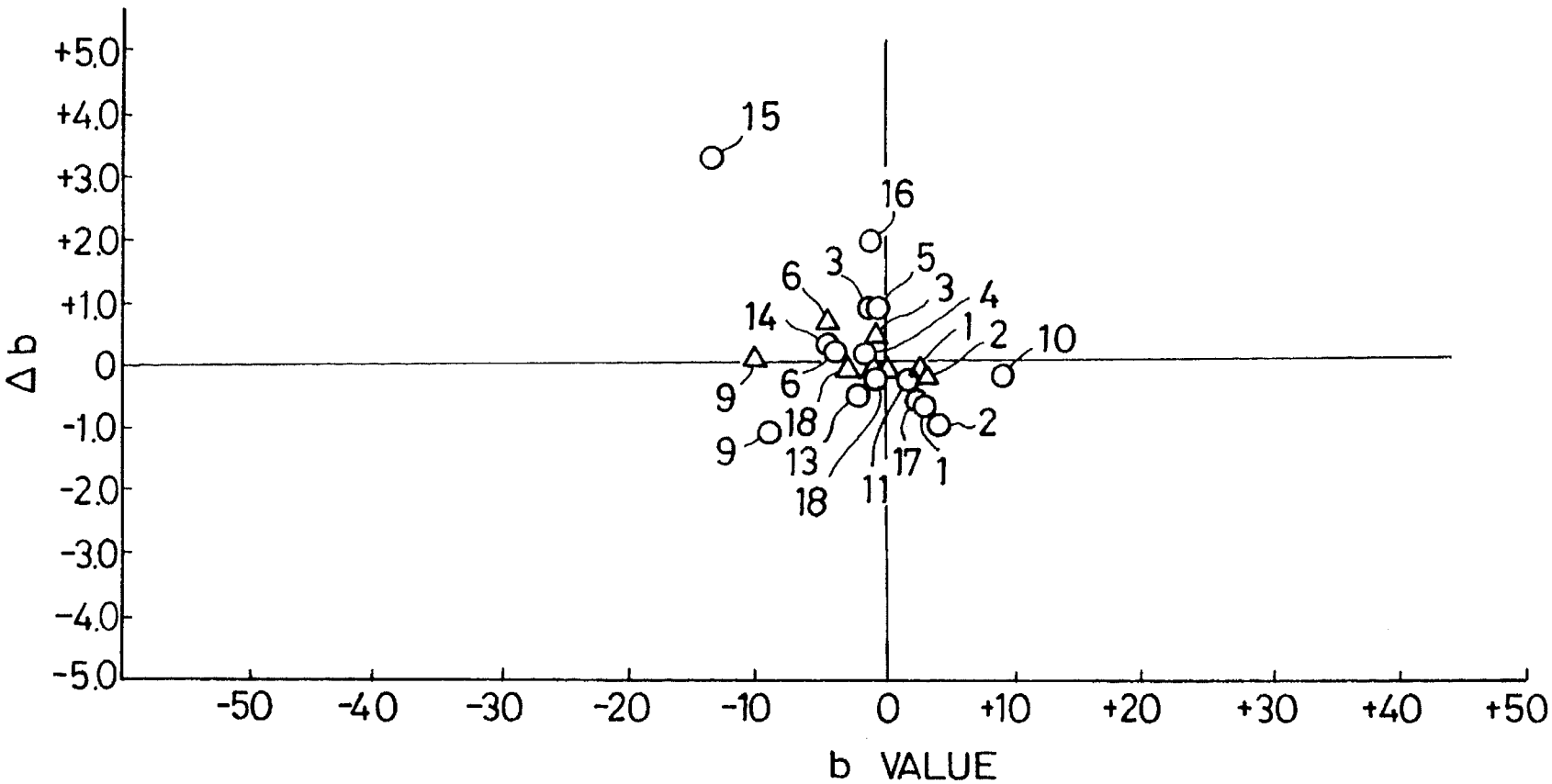
Figure 13:
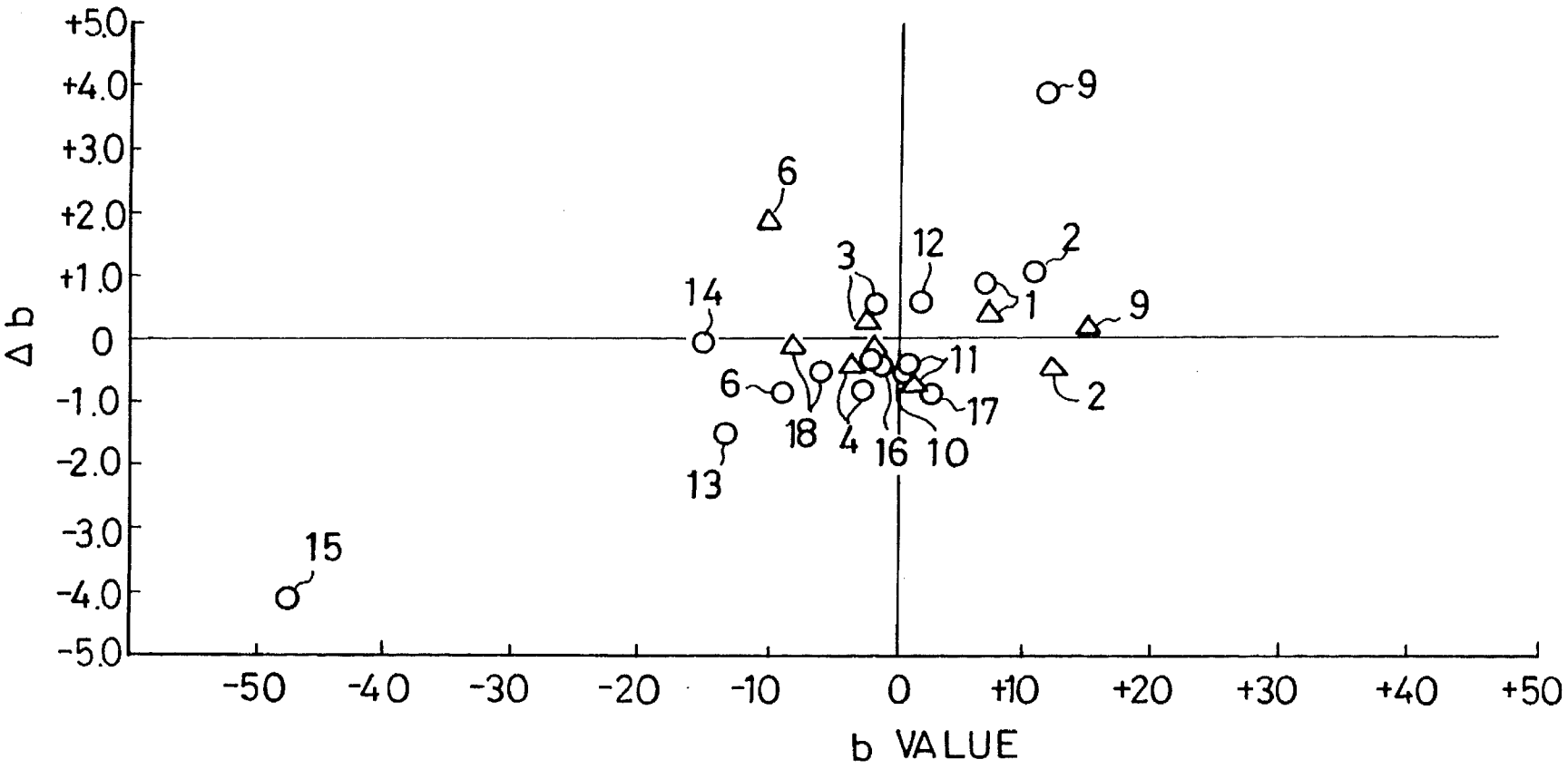
Figure 14:
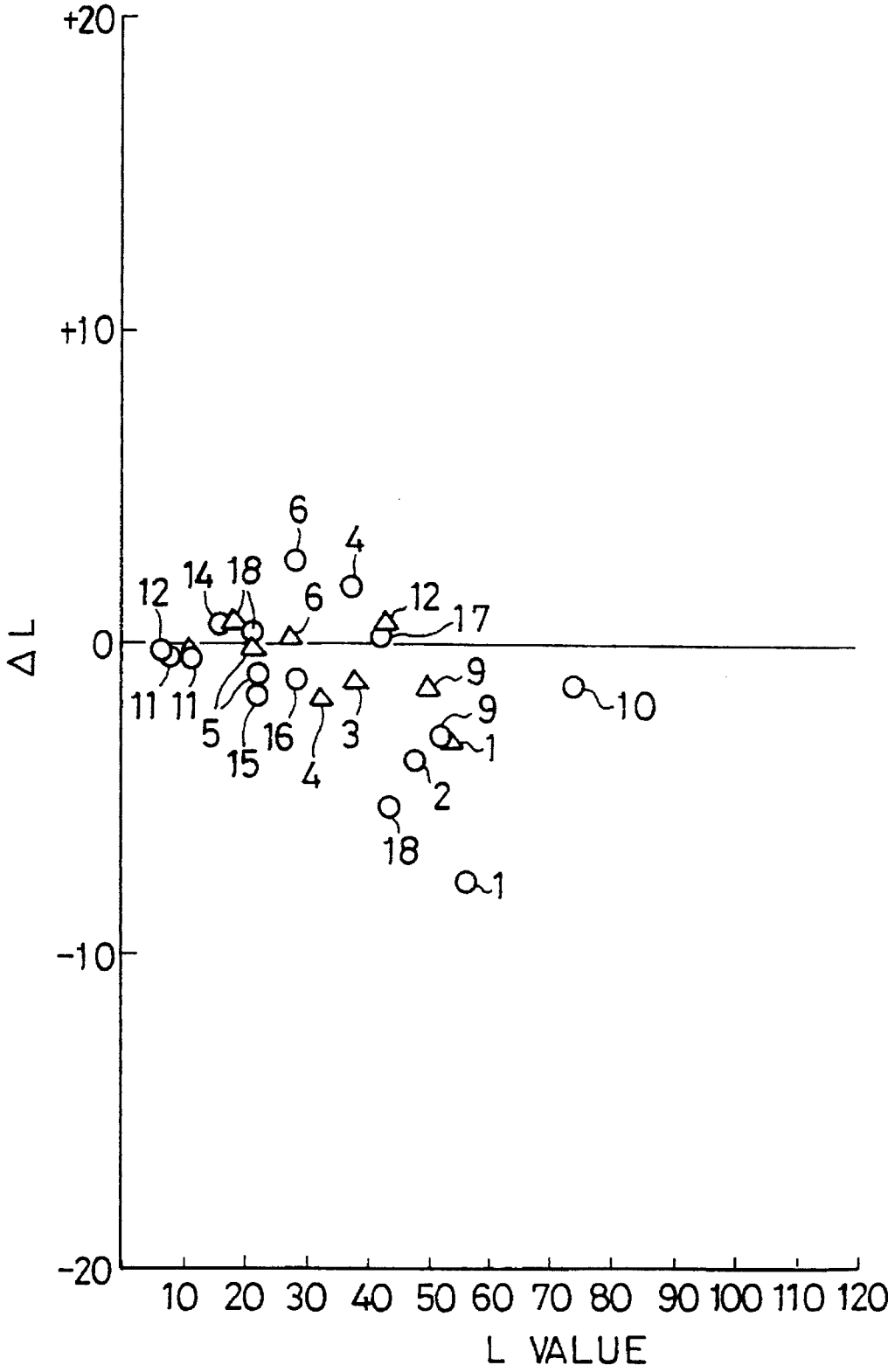
FIGS. 14 to 16 are graphs showing the relationship of the L value vs. the difference ΔL.
Figure 15:
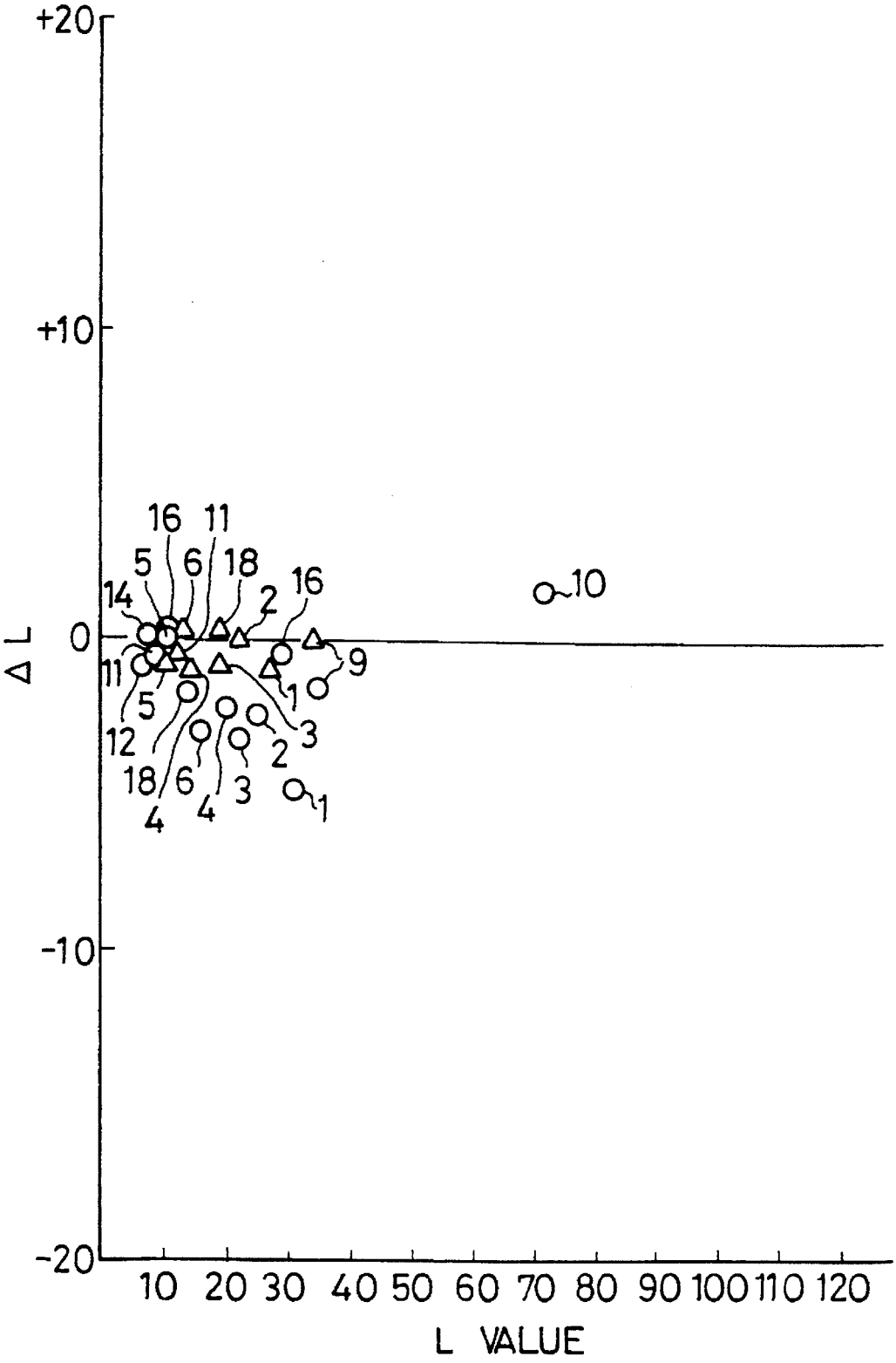
Figure 16:
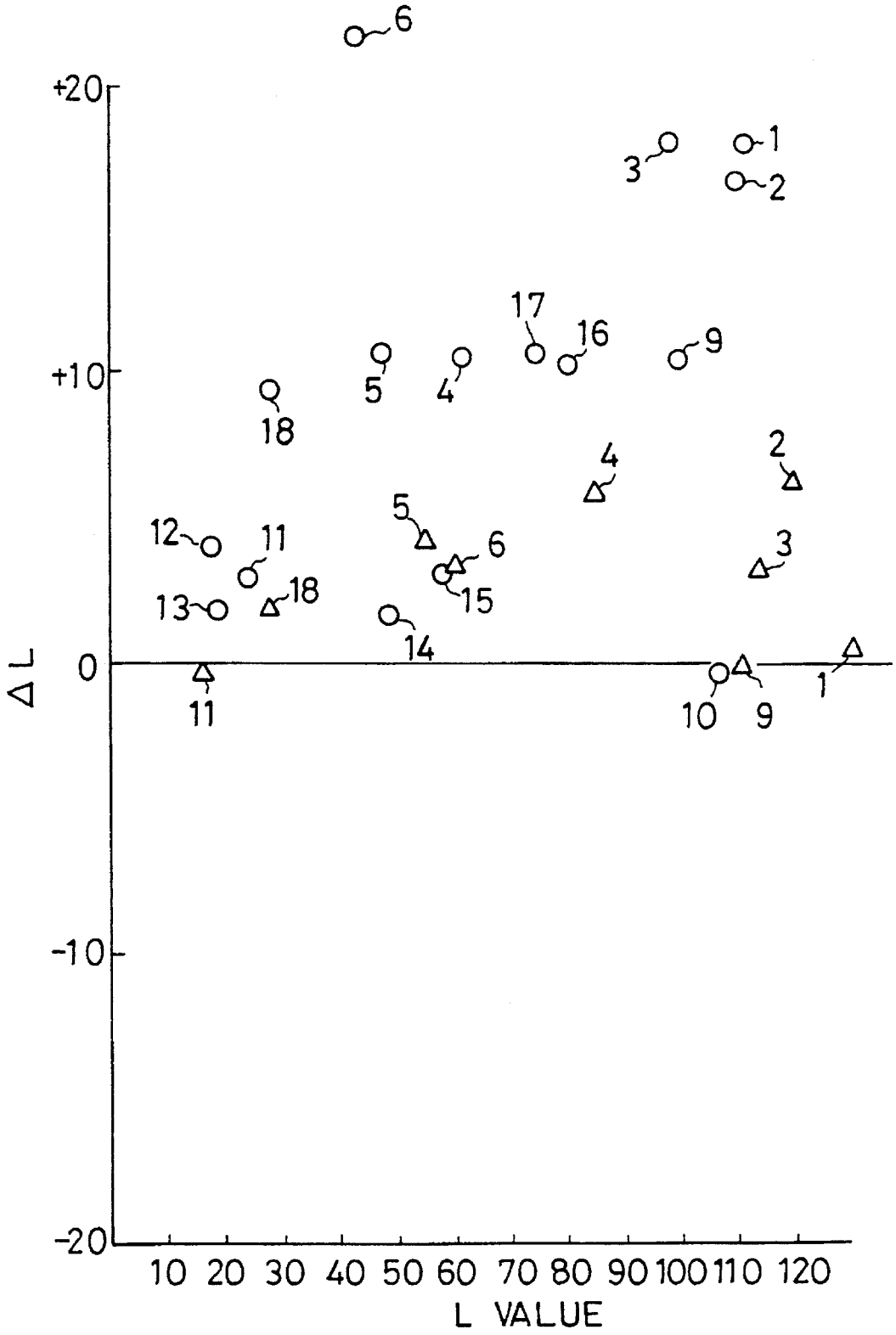

FIGS. 8 to 17 show results of colorfulness when measured by changing the angle of incidence and the angle of sight. In FIGS. 8 to 17, numerals "1" to "18" means sample Nos. and circular symbol means two-stage coating while triangular symbol means three-stage coating. Further, FIGS. 8, 11 and 14 show the results when measured at the angle of incidence of −45° and the angle of sight of 0°. FIGS. 9, 12 and 15 show the results when measured at the angle of incidence of −45° and the angle of sight of −60°, while FIGS. 10, 13 and 16 show the results when measured at the angle of incidence of −45° and the angle of sight of +30°. In FIGS. 8 to 10, it is understood that the a value for the color of the coat prepared by manual spraying means that the color in red gets darker when the difference Δa between the colors of the coat produced by the automatic coating machine and the coat produced by the manual spraying gets greater in the positive direction while the color in green gets darker when the difference Δa gets greater in the negative direction. In FIGS. 11 to 13, the b value for the color of the coat produced by the manual coating means that the color in yellow gets darker when the difference Δb between the colors of the coat produced by the automatic coating machine and the coat produced by the manual spraying gets greater in the positive direction while the color in blue gets darker as the difference Δb gets greater in the negative direction. Further, the L value for the color of the coat produced by the automatic coating machine means that the color in white gets brighter as the difference ΔL between the colors of the coat produced by the automatic coating machine and the coat produced by manual spraying gets larger in the positive direction while the color becomes more greyish as the difference ΔL gets greater in the negative direction.

Figure 17:
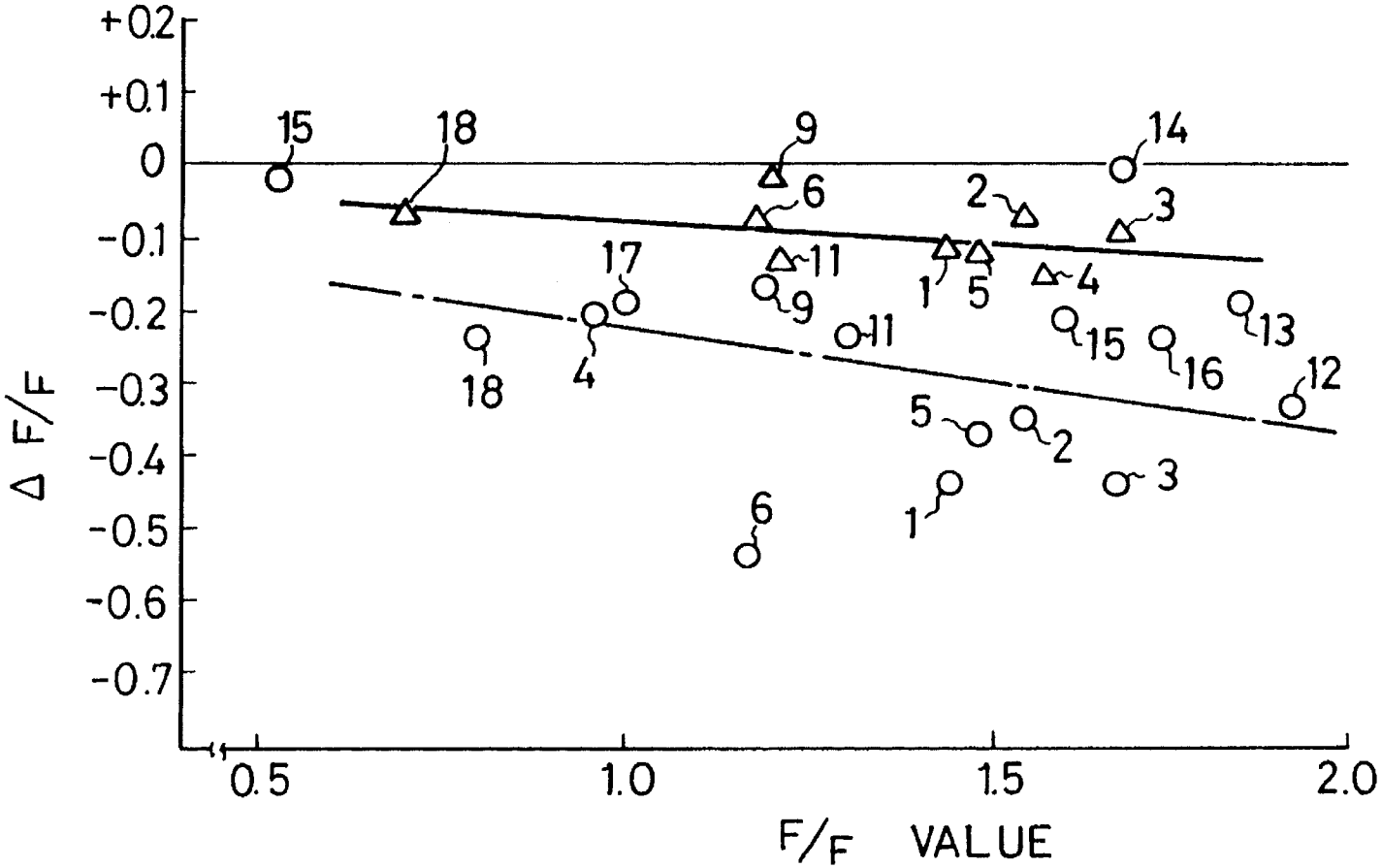
FIG. 17 is a graph showing flip-flop values.

FIG. 17 shows a flip-flop value (F/F) which indicates an extent to which the color of the coat varies with the angle at which the coat is viewed. In FIG. 17, the x-axis indicates the F/F value ($L_0$–$L_{30}o$) for the color of the coat produced by manual spraying while the y-axis indicates the difference ΔF/F between the colors of the coat produced by the manual spraying and the coat produced by the automatic coating machine. And in FIG. 17, the solid line and one-dotted line means F/F values for the coats obtained by manual spraying, and it is understood that the closer the result is to the solid line or the one-dotted line, the closer the coat will be to the coat obtained by manual-spraying. It is noted herein that the F/F value is given by:

$$F/F=(\log L_0-\log L_{30}o)$$

As is apparent from FIGS. 8 to 17, the three-stage coating is superior to the two-stage coating.

The automatic coating line construction of the present invention can realize or produce the color on the coat closer to the color on the coat obtained by manual spraying, i.e. to the original color inherent in the paint used. And it is effective for preventing the paint from sagging. Further, when the original color or the color closer thereto can be realized or produced without using all the stages, the coating stages can appropriately be chosen, thereby readily changing the interval period of time. Furthermore, the automatic coating line construction according to the present invention can save the cost of paint by changing the paints for the coating stage and the other coating stage which follows.

What is claimed is:

1. An apparatus for coating an automotive vehicle body with a coating paint, comprising:

at least three coating stages and coating means disposed in each of the at least three coating stages, each of the coating means being operable to coat the automotive vehicle body with a coating paint of substantially equal color to a coating paint with which the coating means in the others of the at least three coating stages coat the automotive vehicle body, the coating stages being disposed sequentially in a row along a coating line in a direction along which the automotive vehicle body is conveyed as it is coated by the apparatus;

transfer means for transferring the automotive vehicle body from one coating stage to another; and selecting means for selecting at least two of the coating stages in accordance with information concerning a characteristic of paint to be sprayed on the automotive vehicle body;

wherein:

at least one of the at least three coating stages is operable to coat an outer plate panel of the automotive vehicle body with a base overcoating paint, the coating means disposed in each of at least two of the at least three coating stages is a coating unit of an air-nozzle type, at least one coating stage of the at least three coating stages includes a coating unit of a rotary-type atomizing type and is located upstream along the direction of conveyance of the automotive vehicle body relative to a coating stage that includes a coating unit of the air-nozzle type, and at least one of the at least three coating stages comprises a coating stage for coating an inner plate panel of the automotive vehicle body and is disposed between the coating stage in which the rotary-type atomizing coating unit is disposed and a coating stage in which the air-nozzle type coating unit is disposed.

2. An apparatus as claimed in claim 1, wherein a coating robot is mounted in the coating stage for coating the inner plate panel of the automotive vehicle body.

3. An apparatus, comprising at least three coating stages for coating a substrate with an overcoating paint during conveyance of the substrate, wherein:

each of the coating stages is so disposed sequentially along a coating line on which the substrate is conveyed as to coat the substrate sequentially with one paint after another without drying the paint previously coated thereon; and each of the coating stages is provided with a coating unit;

wherein the coating unit disposed in each of at least two of the at least three coating stages is a coating unit of an air-nozzle type; and at least one coating stage of the at least three coating stages includes a rotary-type atomizing coating unit and is located upstream along the direction of conveyance of the substrate relative to two coating stages that include coating units of the air-nozzle type.

4. An apparatus for coating a body of a vehicle with a coating paint, comprising:

at least three coating stages and coating means disposed in each of the at least three coating stages, each of the coating means being operable to coat the body of the vehicle with a coating paint of substantially equal color to a coating paint with which the coating means in the other of the at least three coating stages coat the body of the vehicle, the coating stages being disposed sequentially in a row along a coating line in a direction along which the body of the vehicle is conveyed as it is coated by the apparatus;

transfer means for transferring the body of the vehicle from one coating stage to another without allowing the coating paint to dry on the body of the vehicle;

selecting means for selecting at least two of the coating stages in accordance with information concerning a characteristic of paint to be sprayed on the body of the vehicle; and control means for shifting a coating state of a body between a first coating state in which the body is coated with the coating paint in all the coating stages and a second coating state in which the body is coated with the coating paint in two coating stages only, in accordance with information coded on the body of the vehicle;

wherein:

said coating paint to be coated in each of said coating stages is a coating paint for forming an overcoat on the body of the vehicle;

said coating stages comprise a first coating stage, a second coating stage and a third coating stage, said first coating stage being disposed upstream of said second coating stage in the direction along which the body is conveyed and said second coating stage being disposed upstream of said third coating stage in the direction along which the body is conveyed;

said coating means disposed in said first coating stage comprises a rotary-type atomizing coating unit capable of spraying the coating paint;

said coating means disposed in each of said second and third stages comprising an air-nozzle type coating unit; and said first, second and third coating stages are positioned so that an interval of conveyance of a body between said first coating stage and said second coating stage is longer than an interval of conveyance of a body between said second coating stage and said third coating stage.

5. An apparatus for coating a substrate with paint during conveyance of the substrate, comprising:

a rotary-type atomizing coating unit disposed along a coating line on which the substrate is conveyed and operable to coat the substrate with paint; and an air-nozzle type coating unit disposed along the coating line on which the substrate is conveyed and operable to coat the substrate with paint, said air-nozzle type coating unit being positioned downstream of said rotary-type atomizing coating unit relative to a direction of motion of the substrate and being spaced from said rotary-type atomizing coating unit so that the paint applied by said rotary-type atomizing coating unit does not dry prior to application of paint by said air-nozzle type coating unit.

6. The apparatus of claim 5, wherein said air-nozzle type coating unit comprises a first stage having a first air-nozzle type sprayer and a second stage having a second air-nozzle type sprayer.

7. An apparatus for coating an automotive vehicle body with a coating paint, comprising:

a first coating unit disposed along a coating line on which the automotive vehicle body is conveyed and operable to coat an outer surface of the automotive vehicle body with paint;

a second coating unit disposed along the coating line on which the automotive vehicle body is conveyed and operable to coat an inner surface of the automotive vehicle body with paint, said second coating unit being positioned downstream of said first coating unit relative to a direction of motion of the automotive vehicle body; and a third coating unit disposed along the coating line on which the automotive vehicle body is conveyed and operable to coat the outer surface of the automotive vehicle body with paint, said third coating unit being positioned downstream of said second coating unit relative to a direction of motion of the automotive vehicle body;

wherein the first coating unit comprises a rotary-type atomizing coating unit and the third coating unit comprises an air-nozzle type coating unit.

8. The apparatus of claim 7, wherein said air-nozzle type coating unit comprises a first stage having a first air-nozzle type coater and a second stage having a second air-nozzle type coater.

9. An apparatus for coating a substrate with paint during conveyance of the substrate, comprising:

a rotary-type atomizing coating unit disposed along a coating line on which the substrate is conveyed and operable to coat the substrate with paint;

a first air-nozzle type coating unit disposed along the coating line on which the substrate is conveyed and operable to coat the substrate with paint, said air-nozzle type coating unit being positioned downstream of said rotary-type atomizing coating unit relative to a direction of motion of the substrate; and a second air-nozzle type coating unit disposed along the coating line on which the substrate is conveyed and operable to coat the substrate with paint, said second air-nozzle type coating unit being positioned downstream of said first air-nozzle type coating unit relative to a direction of motion of the substrate; wherein:

said rotary-type atomizing coating unit and said first and second air-nozzle type coating units are spaced relative to each other and relative to motion of the substrate on the coating line so that a time interval from a time that the rotary-type atomizing coating unit coats the substrate with paint to a time that the first air-nozzle type coating unit coats the substrate with paint is larger than a time interval from the time that the first air-nozzle type coating unit coats the substrate with paint to a time that the second air-nozzle type coating unit coats the substrate with paint.

* * * * *